United States Patent [19]

Dölp

[11] Patent Number: 4,524,968

[45] Date of Patent: Jun. 25, 1985

[54] DEVICE FOR ACCOMMODATING BILLIARD BALLS IN SPACES PROVIDED FOR BILLIARDS PLAYING

[76] Inventor: Heinrich Dölp, Kimbacher Strasse 211, D-6123 Bad König, Fed. Rep. of Germany

[21] Appl. No.: 577,127

[22] Filed: Feb. 6, 1984

[30] Foreign Application Priority Data

Feb. 9, 1983 [DE] Fed. Rep. of Germany ..... 3304439

[51] Int. Cl.[3] ..... A63D 15/00

[52] U.S. Cl. ..... 273/2; 211/14; 340/568

[58] Field of Search ..... 273/2, 10, 11 R, 11 C, 273/14; 211/14, 15; 340/568

[56] References Cited

U.S. PATENT DOCUMENTS 116,561 7/1871 Collender ..... 211/14

1,558,539 10/1925 Freeman ..... 211/15

FOREIGN PATENT DOCUMENTS 539876 4/1922 France ..... 340/568

*Primary Examiner*—Harland S. Skogquist

*Attorney, Agent, or Firm*—Michael J. Striker

[57] ABSTRACT

A device for keeping ready billiard balls has a housing, a plurality of holding elements at the front side of the housing for receiving billiard balls, a coin receiver for determining a game time, an acoustic signal generating element which emits an acoustic signal when billard balls are removed for playing or after termination of the predetermined game time until they are returned back into the holding elements, wherein during unauthorized withdrawal of billiard balls from the holding elements an acoustic signal is also generated, contact elements provided with feelers in the region of the holding elements and connected with an electronic circuit to show whether all billiard balls are in the holding elements or some of them are missing, and an indicating element at the front side of the device to show the remaining game time available for a player.

14 Claims, 4 Drawing Figures

DEVICE FOR ACCOMMODATING BILLIARD BALLS IN SPACES PROVIDED FOR BILLIARDS PLAYING

BACKGROUND OF THE INVENTION

The present invention relates to a device for accommodating (keeping ready) billiard balls in spaces provided for billiards playing.

Billiard tables are provided in restaurants, game salons, etc., and customers conventionally pay for billiards playing. For releasing personnel from the difficulties of cashing game money, it is known to provide devices with a box-shaped housing which accommodates billiard balls and releases the same for playing upon insertion of coins. These known devices are conventionally mounted under the plate of the billiards table. Known devices have holding elements accommodating billiard balls, a coin receiver, an indicating element actuated by coins for showing the provided game time, contact elements with actuating members associated with the holding element, and a meter actuated by the insertion of coins and emitting a signal after expiration of a predetermined time.

The DE-GM No. 1,877,257 discloses a billiards time clock in which the billiard balls are located in the openings of the housing and cooperate in their immovable position with table switches. The latter interrupt a current circuit to an article and/or acoustic signal element, closes the current circuit upon withdrawal of one billiard ball and releases the signal element. It was proposed in this DE-GM to use a further switch in the respective current circuit, which can additionally interrupt the current circuit via a lever loaded by coins and thereby prevent the actuation of the signal element despite withdrawal of the billiard balls.

SUMMARY OF THE INVENTION

Accordingly, it is an object of the present invention to provide a different device for accommodating of billiard balls which more reliably detects the presence of billiard balls in a holding unit by air contact unit, protects the contact unit from unauthorized manipulations, and sets the game time indicator with the beginning of the game.

In keeping with these objects and with others which will become apparent hereinafter, one feature of the present invention resides, briefly stated, in a device for accommodating (keeping ready) billiard balls in which holding elements for billiard balls are arranged at the front side of the housing and actuating elements of the contact elements are spaced from a center of the respective holding elements by a distance smaller than the radius of the billiard ball, limiting elements are arranged at the opposite side of the contact element for limiting the horizontal displacement of the billiard balls so that the end of the displacement of the billiard balls is located prior to the end of the permissible displacement of the actuating members, the indicating element is arranged at the front side of the housing and shows a remaining used time, and between the billiard balls in the holding elements and the actuating members for the contact elements a yieldable membrane is arranged.

When the device is designed in accordance with the present invention it is not possible to replace a withdrawn billiard ball by another object, for example a beer bottle, and thereby to bring the associated contact to the position corresponding to the presence of a billiard ball.

The contacts are reliably protected against dirtying by the arrangement of the yieldable membrane and thereby have a longer maintenance-free operation. The arrangement of the indicating device for indication of the remaining available time better serves the interests of the player.

It is advantageous when the membrane at the opposite side from the billiard balls is covered by a wall having openings for the individual billiard balls, since the membrane is protected against damage by insertion or withdrawal of the billiard balls. In accordance with an advantageous embodiment of the invention, these openings are circular openings and dimensioned so that the individual billiard balls contact the edges of the associated openings and in this position the respective parts ofthe billiard ball bulge the membrane in direction toward the actuating members of the associated contact elements.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENT

Figure 1:
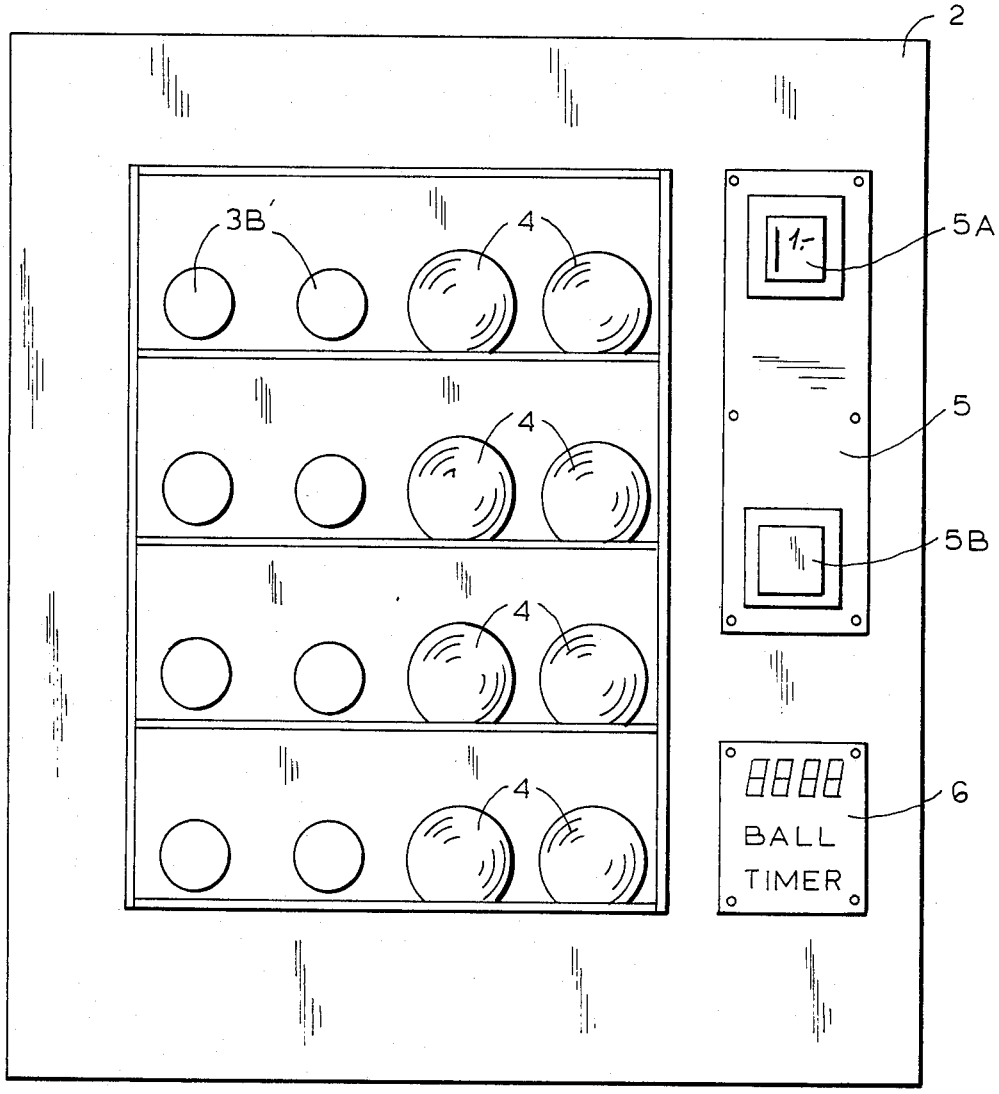
FIG. 1 is a view showing a front side of a device for accommodating billiard balls, in accordance with the present invention.

A device for keeping ready billiard balls in accordance with the present invention has a box-shaped housing 2 which is provided at its front side with a holding element 3 for billiard balls 4, with a coin receiver 5 having a receiving opening 5A and a returning opening 5B, as well as an indicating element 5 for respective available play time. The holding element 3 is formed as a frame insertable into the front side of the device. The frame has horizontal ribs 3A with circular openings 3A' for the billiard balls 4, and a vertical rear wall 3B with circular openings 3B' for receiving the rear region of the inserted balls.

Figure 4:
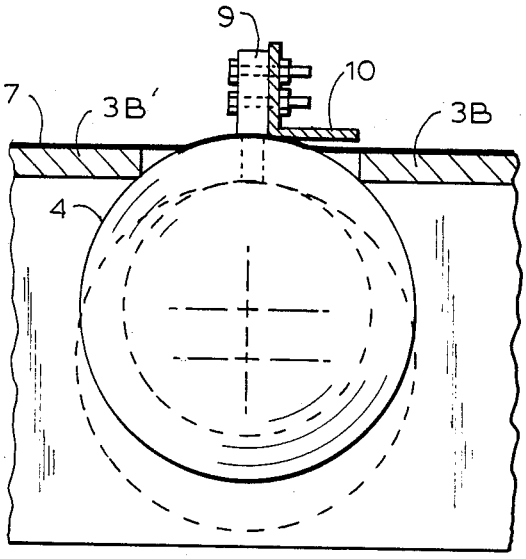
FIG. 4 is a view showing a further structural detail in a horizontal section through a wall arranged at the rear side of the billiard balls and an associated holding element, as seen from above.
Figure 3:
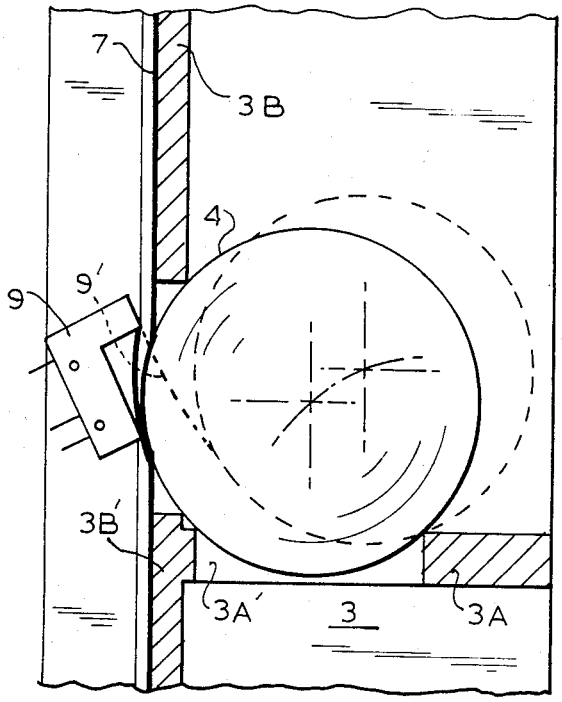
FIG. 3 is a view showing a structural detail on an enlarged scale of a billiard ball in an associated holding element with a contact element, in a vertical section as seen from one side.

A fabric cover 7 is mounted on the rear wall 3B, and more particularly at its side facing away from the billiard balls 4 and has a cover corresponding to the cover of the billiards table. When a billiard ball 4 is inserted in the associated holding element, as shown in FIGS. 3 and 4 by a solid circular line, the fabric cover 7 bulges rearwardly and displaces a feeler 9' of a contact element 9 to a position shown in FIG. 3, so that the contact in the contact element 9 is closed. A vertical shaped guide 10 is mounted on the rear wall 3B and limits the bulging of the fabric cover 7 during insertion of the billiard ball.

It is thereby guaranteed that the movement of the feeler 9' resulting from the insertion of a billiard ball lies within the displacement path allowable therefor. Broken circular lines in FIGS. 3 and 4 show the position of a billiard ball during withdrawal from the associated holding element. The position which is assumed then by the feeler 9' is also shown in a broken line. When the feeler 9' assumes a position shown in broken lines in FIG. 3, the contact in the contact element 9 opens, the associated electronic current circuit is interrupted, and the switching element arranged in the device is actuated as will be described hereinbelow.

Figure 2:
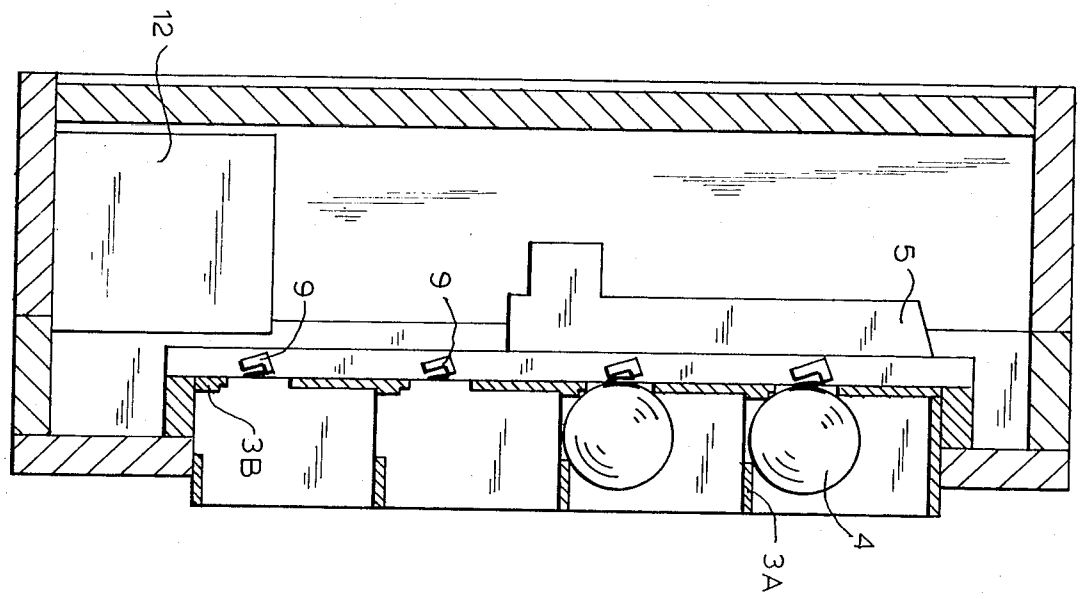
FIG. 2 is a view showing a vertical longitudinal section of the device shown in FIG. 1, from one side.

As can be seen from FIG. 2, a collecting container 12 for the coins thrown into the device is provided under the coin receiver 5. After opening of the housing it is available for withdrawal of the coins. When a coin is thrown into the receiving opening 5A, it is examined by a not shown testing device and failing or false coins are supplied to the returning opening 5B, whereas unobjectionable coins are further transported through the collecting container 12.

The housing 2 is formed of two parts so that the rear part is mountable on a wall, whereas the front part after opening of a lock not shown in the drawing can be turned forwardly to make available the collecting container 12.

The operation of the inventive device which is conventionally mounted in the vicinity of a billiards table on a wall is as follows:

The billiard balls 4 are supported at the front side of the device in the above described holding element so that they are well visible. When a player uses the billiard balls for a billiards game, it shows coins provided for this, for example one mark piece, into the receiving opening **5*a* of the coin receiver 5, and the received coins run through a testing element. If the result of testing is positive, the coin falls into the collecting container and actuates a so-called coin contact. The latter activates with a timing circuit of a not shown electronic circuit located in the housing. Simultaneously a predetermined game time is preprogrammed and shown on the indicating element 6**.

When now the billiard balls 4 are withdrawn from the holding element, a contact element is opened during withdrawal of the first ball and the meter of the electronic circuit starts to run.

During the running time of the meter the available, decreasing game time is continuously shown in minute periods. After expiration of the game time provided by the inserted coins, a buzzer is turned on by the electronic circuit and generates a distinctly recognizable buzzing sound so as to acoustically indicate the end of the game time. The buzzing sound is emitted until all balls are inserted in the associated holding elements and thereby all contact elements are again switched on.

When the player wants to extend the game time prior to its expiration, he can do this at any time by throwing the predetermined coin. The newly provided game time is exactly shown additionally to the eventually available residual time in the indicating element, and the meter starts to count this new game time.

If a billiard ball is withdrawn from the holding element without insertion of the predetermined coins, the associated contact is opened and the buzzer emits an acoustic signal which indicates that a ball is withdrawn in unauthorized manner.

The device further has an accumulator with a charging element which is supplied from local light network. This guarantees that even in the event of a current failure the device will operate for a long time.

The operator of the billiards game arrangement, usually the owner of a restaurant or game parlor, can open the device with the aid of a key and withdraw the coins from time to time. It can further, by actuation of a switch located inside the device, bring for the digital indication on the indicating element 6 the number of coins inserted since the counted time point and to compare the obtained number with the number of the coins withdrawn from the last counted time point. This possibility is especially important when the operator of the billiards game arrangement only rents the device and must pay for its use.

When a player wants to be alerted that its game time will end shortly, a device is provided with an additional element which shows this. For this purpose it is advantageous to assign this additional element so that the device sends an optical signal. For this purpose the indicating device which is well suitable and can be formed so that during last game minutes the continuously lit numerals bring by a corresponding control through the electronic circuit.

The device in accordance with the present invention provides for numerous advantages. All billiard balls are constantly tested by mechanical control switch electronically as to their presence. When one or several billiard balls are withdrawn, thus providing a predetermined game time by the preceding insertion of coins, a recognizable buzzing sound is emitted. When the game times comes to an end, also the same buzzing sound is emitted for such a long time until all balls are not placed back into the device in orderly manner. The device makes practically impossible fraudulent manipulations possible in known devices. The electronic element provided in the device allows simultaneously the correct determination of coins inserted into it during predetermined time intervals. In the event of current failure, which can take place for example by manipulation with fraudulent intentions, the available accumulator provides for the current supply of the device and retains it operating. The coin withdrawal is made more manipulation-reliable by the utilization of a precisely operating coin tester. The device is easily understandable for the user and its use for him is very simple.

It will be understood that each of the elements described above, or two or more together, may also find a useful application in other types of constructions differing from the types described above.

While the invention has been illustrated and described as embodied in a device for keeping ready billiard balls in spaces provided for billiards playing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention.

What is claimed as new and desired to be protected by Letters Patent is set forth in the appended claims.

I claim:

1. A device for keeping ready billiard balls in spaces provided for billiard playing, comprising a housing having a front side; holding means for holding billiard balls and having a plurality of holding elements arranged at said front side in spaced relationship from one another so as to receive therein billiard balls, each of said holding elements having a center point for a billiard ball; contact means arranged to cooperate with the billiard balls and having a plurality of contact elements each located behind a respective one of said holding elements and having an actuating member which is spaced from the center point of the associated holding element by a distance which is smaller than a radius of the billiard ball, each of said actuating members having a permissible displacement path for the associated contact element; limiting means provided behind said contact means for limiting the horizontal displacement of billiard balls so that the end of the displacement path of the billiard balls limited by said limiting means is located prior to the end of the permissible displacement path of said actuating members; indicating means provided on said front side of said housing and arranged to indicate a remaining game time; and a yieldable membrane arranged between the billiard balls when they are received in said holding means and said actuating members of said contact elements.

2. A device as defined in claim 1, wherein said housing is formed box-shaped.

3. A device as defined in claim 1, wherein said holding elements are located adjacent to one another at said front side of said housing.

4. A device as defined in claim 1, wherein said holding elements are located one under the other at said front side of said housing.

5. A device as defined in claim 1, wherein said actuating members are formed as feelers.

6. A device as defined in claim 1, wherein said yieldable membrane is formed of a web of fabric.

7. A device as defined in claim 1, wherein said membrane has a side facing toward the billiard balls; and further comprising a wall covering said membrane from said side and provided with openings for the individual billiard balls.

8. A device as defined in claim 7, wherein said openings are circular and have edges, said circular openings being dimensioned so that when a billiard ball is inserted into contact with the edge of the associated opening and in this position said membrane is bulged by the respective part of the billiard ball in direction towards the actuating member of the respective contact element.

9. A device as defined in claim 1; and further comprising a meter arranged to continuously add the number of coins inserted into the device and to show the respective sum.

10. A device as defined in claim 9; and further comprising a switch arranged so that the respective sum is shown only after actuation of said switch, said indicating means arranged to indicate this sum to be readable by a user.

11. A device as defined in claim 10, wherein said indicating means is arranged at said front side of said housing.

12. A device as defined in claim 10, wherein said indicating means is arranged so that the respective sum is shown in the same indicating field in which the respective residual game time is shown after insertion of a coin and removal of a billiard ball.

13. A device as defined in claim 10, wherein said housing is closable by a key, said switch being located in said housing closable by the key.

14. A device as defined in claim 13, wherein said switch is located in the interior of the device.

* * * * *